US007518581B2

(12) United States Patent
Tyrell

(10) Patent No.: US 7,518,581 B2
(45) Date of Patent: Apr. 14, 2009

(54) COLOR ADJUSTMENT OF DISPLAY SCREENS

(75) Inventor: Julian Tyrell, Cricklade (GB)

(73) Assignee: Dialog Semiconductor GmbH, Kirchheim/ Teck-Nabern (DE)

( * ) Notice: Subject to any disclaimer, the term of this patent is extended or adjusted under 35 U.S.C. 154(b) by 1163 days.

(21) Appl. No.: 10/667,842

(22) Filed: Sep. 22, 2003

(65) Prior Publication Data

US 2005/0052476 A1 Mar. 10, 2005

(30) Foreign Application Priority Data

Sep. 9, 2003 (EP) ..... 03368087

(51) Int. Cl.
*G09G 3/32* (2006.01)

(52) U.S. Cl. ..... 345/83

(58) Field of Classification Search ..... 345/88, 345/600, 603, 605; 315/169.1, 169.4
See application file for complete search history.

(56) References Cited

U.S. PATENT DOCUMENTS

| | | | | |
|---|---|---|---|---|
| 4,409,614 | A | 10/1983 | Eichler et al. | 358/76 |
| 4,725,828 | A * | 2/1988 | Cowlishaw | 345/694 |
| 5,488,390 | A * | 1/1996 | Reinert et al. | 715/856 |
| 5,774,112 | A | 6/1998 | Kasson | 345/153 |
| 6,199,031 | B1 * | 3/2001 | Challier et al. | 703/14 |
| 6,262,817 | B1 | 7/2001 | Sato et al. | 358/518 |
| 6,388,648 | B1 | 5/2002 | Clifton et al. | 345/88 |
| 6,801,213 | B2 * | 10/2004 | Bergstrom et al. | 345/596 |
| 7,034,786 | B2 * | 4/2006 | Ham | 345/88 |
| 2001/0003543 | A1 | 6/2001 | Kagawa et al. | 382/162 |
| 2003/0222839 | A1 * | 12/2003 | Lee | 345/88 |
| 2003/0234756 | A1 * | 12/2003 | Ku et al. | 345/88 |

FOREIGN PATENT DOCUMENTS

| | | |
|---|---|---|
| EP | 1 227468 A2 | 7/2002 |
| EP | 1 265219 A1 | 12/2002 |

* cited by examiner

*Primary Examiner*—Richard Hjerpe
*Assistant Examiner*—Shaheda A Abdin
(74) *Attorney, Agent, or Firm*—Saile Ackerman LLC; Stephen B. Ackerman

(57) ABSTRACT

Systems and methods to linearly scale the colors of display data in a display driver circuit before it is written in a display RAM have been achieved. Said systems and methods invented are applicable to any display type such as e.g. CSTN, DSTN, TFT, OLED, etc. Each primary color value, e.g. red, green and blue is individually adjusted with its own setting, which allows maximum flexibility in display adjustment. Set adjustment is performed to adjust the colors displayed to the specific color characteristics of any display screen type. A system processor sets the red, green and blue color adjust register settings for a particular display type. The display data is downloaded from a system processor into a display RAM via a display adjust circuit, Said display adjust circuit modifies the display data according to the color adjust register setting settings before it is written into the RAM.

36 Claims, 2 Drawing Sheets

COLOR ADJUSTMENT OF DISPLAY SCREENS

BACKGROUND OF THE INVENTION (1) Field of the Invention

This invention relates generally to display systems, and more particularly to a system and a method to adjust colors to be displayed before writing it into a display RAM.

(2) Description of the Prior Art

The colors of digital images have to be normally adjusted to accommodate to the display system used to display said digital images. Without any adjustment a viewer of digital images will not be satisfied with the colors shown. All display systems such as e.g. color super twist nematic (CSTN), thin film transistor (TFT), organic light emitting diode (OLED), or double layer supertwist nematic (DSTN) displays have their specific flaws in displaying colors. Therefore the colors of digital images have to be adjusted to satisfy the expectations of the viewers of said images.

There is a multitude of methods known to perform said color adjustment.

U.S. Pat. No. 6,262,817 (to Sato et al.) describes a color image system for adjusting colors of inputted images including a color adjusting unit and color display unit. The color display unit simultaneously displays the original image, the adjusted image, and color information for both the original image and adjusted image. A color adjustment matrix is created by the color-adjusting unit based upon color directions inputted to the color display unit with respect to the color information of the original color image. The color adjustment matrix is used to directly adjust the original image without converting the image to a second color space. A color-adjusting unit produces a color adjustment matrix by adding color adjustment direction of the luminance, chroma, and hue, directed by the image display unit used, for the original matrix. After the color adjustment matrix being produced, the adjusted pixel can be produced by calculating the original pixel and the color adjustment matrix.

U.S. Pat. No. 6,388,648 (to Clifton et al.) discloses an LCD projection unit employing a luminance and color balance system employing an LCD array characterization lookup table storing multiple sets of luminance and gamma correction values that are user selectable to control luminance and color balance. The lookup table values are determined by measuring the transfer function of the LCD array in the projection unit for each of a set of red ("R"), green ("G"), and blue ("B") input data values, converting the resulting S-curve responses to corresponding sets of gamma responses and scaling the gamma responses to generate multiple R, G, and B families of luminance and gamma corrected values. Color balance is adjusted by selecting the particular R, G, and B families of luminance and gamma corrected values that cause the LCD projection unit to match a predetermined ratio of R, G, and B luminance values. Luminance is adjusted by selecting sets of families of R, G, and B, luminance values that maintain the color balance ratio while causing the LCD to transmit the desired overall luminance. The primary colors are adjusted by a method of color mixing implemented by a mathematical matrix algorithm that generates color modification coefficients for a color space conversion circuit. The primary color matching algorithm involves measuring the intrinsic colors coordinates of the primaries, determining a set of predetermined target coordinates, and performing matrix operations to calculate the coefficients used in the color space conversion circuit to convert the measured to the target coordinates, thereby matching the primary colors. When the primary colors are matched, the above-described color balance and luminance matching system adjusts the white and gray balance to result in a well-matched multiscreen display system.

U.S. Pat. No. 4,409,614 (to Eichler et al.) discloses a method wherein color scanning signals generated by scanning the original image are first converted into three primary color signals having actual color values in a predetermined color coordinate system corresponding substantially identically to theoretical color values of the original. It is only after this conversion that the primary signals or signals derived from these signals are converted to another color rendition system, or the gradation is altered, or the color rendition of individual colors in the overall image or in discrete areas is altered, or any other non-linear processing takes place.

SUMMARY OF THE INVENTION

A principal object of the present invention is to linearly scale the colors of display data.

A further object of the present invention is to achieve a cost effective solution for the scaling of the colors of display data.

Another further object of the invention is to achieve a very fast processing of the adjustment of the colors of display data.

In accordance with the objects of this invention a system to adjust colors in any kind of electronic display has been achieved. Said system comprises a color screen used as a display using primary colors of a color space, a system processor sending downloading display data to a display driver circuit, and a display driver circuit. Said display driver circuit comprises a processor interface logic providing the interface between said system processor and said display driver circuit, a display adjust circuit adjusting the display data received from said system processor via said processor interface logic and writing said modified display data into a display RAM, one or more color adjust registers, a display RAM for storing the adjusted display data, and a screen driver controlling said screen and sending said adjusted display data to said screen.

In accordance with the objects of the invention a method to adjust colors in any kind of electronic display has been invented. Said method comprises, first, providing a display screen, a system processor, and a display driver circuit comprising a processor interface logic, a display adjust circuit, one or more color adjust registers, a display RAM and a screen driver circuit. The steps of said method are to define adjustment data for each primary color used by said display screen to adjust said colors according to the properties of said screen, to store said adjustment data for each primary color in one or more registers providing one or more bits for each primary color, to define a word structure to operate the unadjusted display data and to store the adjusted display data in a display RAM wherein for each primary color a defined number of bits is assigned, and to implement an algorithm to adjust each of the primary colors, used by said screen, in said display adjust circuit using a hardware description language. These steps are followed by to download display data from system processor into display adjust circuit, to adjust display data in display adjust circuit according to algorithm implemented earlier and according adjustment data defined and stored earlier and write adjusted display data into display RAM, and to forward adjusted display data from the display RAM to the display screen by the screen driver circuit.

BRIEF DESCRIPTION OF THE DRAWINGS

In the accompanying drawings forming a material part of this description, there is shown.

DESCRIPTION OF THE PREFERRED EMBODIMENTS

The preferred embodiments disclose a system and a method to linearly scale display data before it is written into a display RAM. The embodiments of the present invention are applicable to any electronic display types, such as e.g. color super twist nematic (CSTN), thin film transistor (TFT), organic light emitting (OLED), or double layer supertwist nematic (DSTN) displays. Compared to prior art solutions the system and method invented provide a fast and very cost effective way to adjust colors of digital images according to color characteristics of the display type used.

Figure 1:
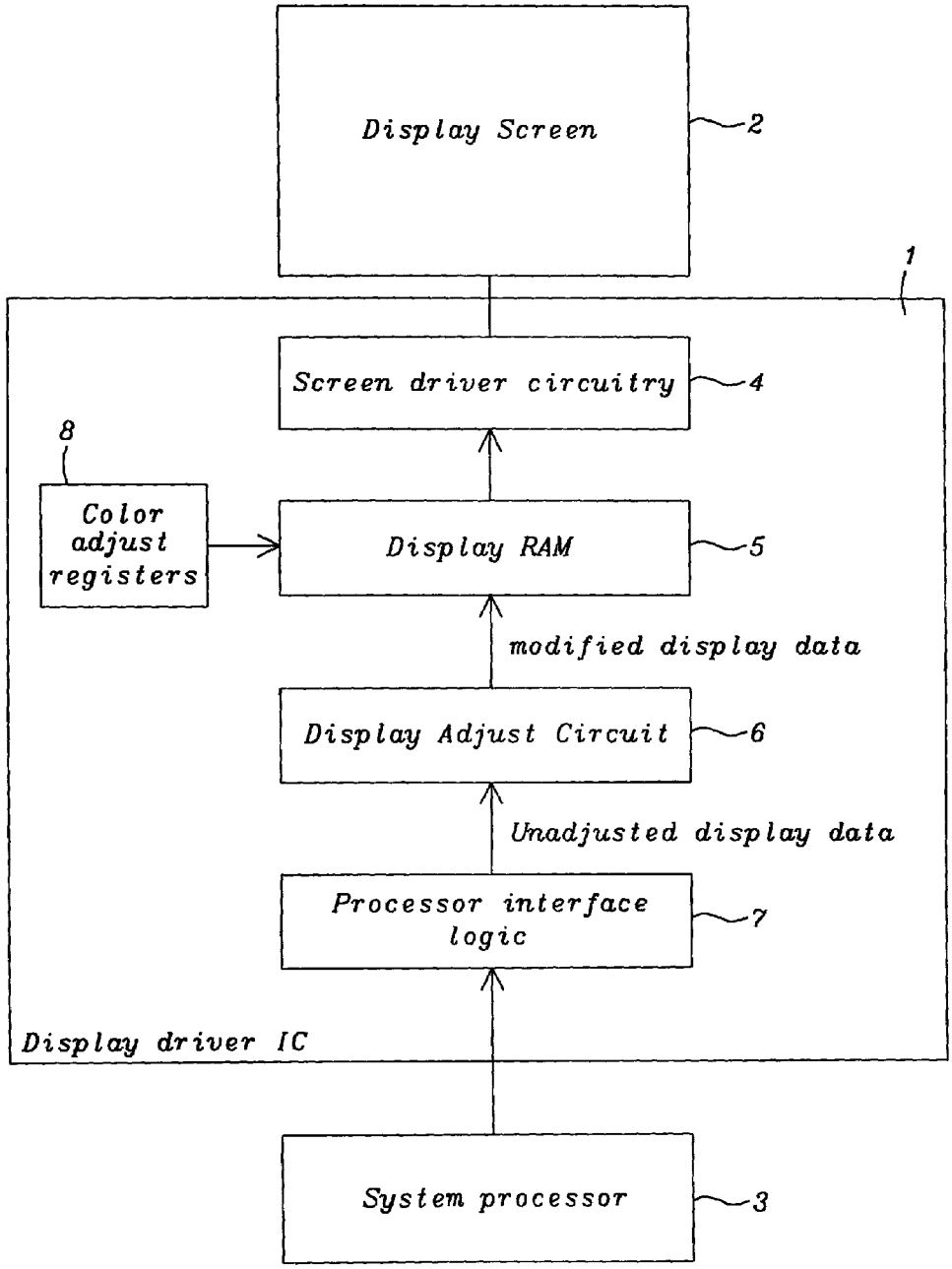
FIG. 1 illustrates in a block diagram the basic components of the system invented.

FIG. 1 shows a block diagram of a preferred embodiment of the present invention. The display system shows a display driver IC 1, being key to the present invention. Furthermore the system comprises a display 2 and a system processor 3. As mentioned above, said display 2 could be any type of display. Said display driver IC 1 is characterized, compared to prior art, by having a display adjust circuitry 6 which is receiving unadjusted display data from a processor interface logic 7, adjusting said unadjusted display data using color adjust registers 8 for red, green, and blue, and writing the adjusted display data into a display RAM 5, containing display data to be displayed on a screen display 2. Furthermore said system comprises a screen driver circuitry 4, driving said screen display.

For those skilled in art it is obvious that the display driver circuit described above lends itself to an implementation in an ASIC circuit.

The displayed colors can be adjusted by a simple integer multiplication of the color data value before writing into the display RAM 5. In a preferred embodiment a 65K color display has a 16-bit word split into a red, green and blue component. In other embodiments color displays using other color spaces besides RGB, e.g. CMY, could be used as well.

The table below shows the word structure used in an embodiment of the present invention. Five bits are provided for red, six bits are provided for green and five bits are provided for blue in the 16-bit structure selected in said preferred embodiment. Using the word structure shown of the table below 32 different values of red, 64 different values of green and 32 different values of blue could be shown in case of unadjusted display data. This would result in having a palette of 32×64×32, this means 65536 different colors.

| 5-bit RED | 6-bit GREEN | 5-bit BLUE |
|---|---|---|
| R4 R3 R2 R1 R0 | G5 G4 G3 G2 G1 G0 | B4 B3 B2 B1 B0 |

Each color value is individually adjusted with its own setting, which allows maximum flexibility in display adjustment. The system processor 3 sets the red, green and blue color adjust register settings for the particular display (e.g. LCD, TFT, OLED). The display data is downloaded from the system processor 3, the display color adjust circuitry 6 adjusts said display data before it is written into the display RAM 5.

The display data in a preferred embodiment is linearly scaled by a programmable amount. The multiplication factor is chosen to give a simple logic implementation.

The table below shows for RED, represented in 5 bits, depending upon the multiplication factor n, the related scaling factor, the mathematical equation used, the related percentage of change of RED, and the related number of colors that can be displayed. It is obvious, that the color BLUE, represented in 5 bits as well, has exact the same characteristics in regard of adjustment as RED shown in the table below. Therefore BLUE is not shown in a separate table.

The table below shoes how the color RED could be decreased or increased depending upon the multiplication factor n and the positive or negative algebraic sign of the mathematical equation used It should be understood that the mathematical operations used can be performed extremely fast by simple operations of internal registers.

The right-hand column shows how the number of different colors, which can be totally displayed, decreases upon the amount of increase/or decrease of RED. This reduction of the number of colors is caused by the mathematical operations (shift of registers) during the adjustment. Again, the color BLUE has the identical values as RED shown in the table below.

| Scaling factor | Mathematic equation | Wherein n = | % change | No. of colors |
|---|---|---|---|---|
| RED × 3/4 | RED − RED/$2^n$ | 2 | −25% | 25 |
| RED × 7/8 | RED − RED/$2^n$ | 3 | −12.5% | 29 |
| RED × 15/16 | RED − RED/$2^n$ | 4 | −6.3% | 31 |
| RED × 1 | No change | | 0 | 32 |
| RED × 17/16 | RED + RED/$2^n$ | 4 | +6.3% | 31 |
| RED × 9/8 | RED + RED/$2^n$ | 3 | +12.5% | 29 |
| RED × 5/4 | RED + RED/$2^n$ | 2 | +25% | 26 |

If the result of the mathematic equation RED+RED/$2^n$ is greater than 31, the result is limited to 31 due to the 5-bit limit.

The table below shows the values of colors, being represented by 6 bits. As explained earlier, GREEN is represented by 6 bits in a preferred embodiment of the invention. The table below shows the same columns as the table above. It is obvious that by using 6 bits, compared to 5 bits in the previous table, the adjustment can be performed in additional two steps (one step more each to increase or decrease the color value) and the numbers of different colors, which can be displayed is significantly higher.

| Scaling factor | Mathematic equation | Wherein n = | % change | No. of colors |
|---|---|---|---|---|
| GREEN × 3/4 | GREEN − GREEN/$2^n$ | 2 | −25% | 49 |
| GREEN × 7/8 | GREEN − GREEN/$2^n$ | 3 | −12.5% | 57 |
| GREEN × 15/16 | GREEN − GREEN/$2^n$ | 4 | −6.3% | 61 |
| GREEN × 31/32 | GREEN − GREEN/$2^n$ | 5 | −3.1% | 63 |
| GREEN × 1 | No change | | 0% | 64 |
| GREEN × 33/32 | GREEN + GREEN/$2^n$ | 5 | +3.1% | 63 |
| GREEN × 17/16 | GREEN + GREEN/$2^n$ | 4 | +6.3% | 61 |
| GREEN × 9/8 | GREEN + GREEN/$2^n$ | 3 | +12.5% | 57 |
| GREEN × 5/4 | GREEN + GREEN/$2^n$ | 2 | +25% | 52 |

If the result of the mathematic equation GREEN+GREEN/$2^n$ is greater than 63, the result is limited to 63 due to the 6-bit limit.

As mentioned earlier, in a preferred embodiment of the present invention, representing RED and BLUE with 5 bits each and representing GREEN with 6 bits, a palette of 65 536 different colors can be displayed using unadjusted color values. A typical adjustment comprises 0% change of RED, +6% change of GREEN, and 0% change of BLUE. Using said typical adjustment 32 different values of RED, 61 different values of GREEN and 32 different values of BLUE can be displayed. This would result in having a palette of 32×61×32, this means 62 464 different colors can be displayed. A rather severe adjustment could result in −12% change of RED and BLUE and +6% change of GREEN. This would result in having a palette of 29×61×29, this means 51301 different colors could still be displayed.

The table below shows how the color adjust registers are used in a preferred embodiment of the present invention to store the color adjust information. In a preferred embodiment two registers having 8 bits (B0 to B7) each are being used. In register 1 the three bits B0 to B2 are used to store the red color adjustment data (RCA 2:0). The data for the blue color adjustment (BCA 2:0) are stored in the three bits B4 to B6 of register 1. The data for the green color adjustment (GCA 3:0) are stored in four bits B0 to B3 of register 2.

| | B7 | B6 | B5 | B4 | B3 | B2 | B1 | B0 |
|---|---|---|---|---|---|---|---|---|
| register 1 | | | BCA(2:0) | | | | RCA(2:0) | |
| register 2 | | | | | | GCA (3:0) | | |

The next table shows how in a preferred embodiment the three bits for the red color adjustment RCA (2:0) are used: The percentage values of the table below show the amount of increase/decrease of the color value of RED.

011=+25% (2-bit shift and add)
010=+12.5% (3-bit shift and add)
001=+6.3% (4-bit shift and add)
000=no change (default value)
101=−6.3% (4-bit shift and subtract)
110=−12.5% (3-bit shift and subtract)
111=−25% (2-bit shift and subtract)

The same arrangement of bits is used for the blue color adjustment BCA (2:0) having three bits of adjustment data as well. As shown in the register table above Green color adjustment GCA (3:0) is performed using four bits adjustment data. For example the bit arrangement for green color adjustment in a preferred embodiment of the present invention is as follows:

0100=+25% (2-bit shift and add)
0011=+12.5% (3-bit shift and add)
0010=+6.3% (4-bit shift and add)
0001=+3.1% (5-bit shift and add)
0000=no change (default value)
1001=−3.1% (5-bit shift and subtract)
1010=−6.3% (4-bit shift and subtract)
1011=−12.5% (3-bit shift and subtract)
1100=−25% (2-bit shift and subtract).

For the implementation of the algorithms described above in the Display Adjust Circuit 6 register transfer level code (RTL) language has been used in a preferred embodiment. While RTL was very effective other Hardware Description Languages (HDL) could have been used as well. An example of said RTL code used for red color adjustment is shown here:

```
module (code, rca, res)
input code[5], rca[3];
output res[5];
reg a[5], b[5], c[6], ci;
//reset register b
```

-continued

```
b = 5'b00000;
if (rca[1:0] == 2'b01) //4-bit shift
    begin
        b[0] = code[5];
    end
if (rca[1:0] == 2'b10) //3-bit shift
    begin
        b[1] = code[5];
        b[0] = code[4];
    end
if (rca[1:0] == 2'b11) //2-bit shift
    begin
        b[2] = code[5];
        b[1] = code[4];
        b[0] = code[3];
    end
if (rca[2] == 1'b0) //addition
    begin
        ci = 1'b0;
        a = b;
    end
else
    begin //subtract using two's complement maths
        ci = 1'b1;
        a = ~b;
    end
//addition for code
assign c = code + a + ci;
//check for carry out &addition
if ((c[5] == 1'b1) &&(rca[2] == 1'b0))
    res = 5'b11111;
else
    res = c;
endmodule;
```

For those skilled in art the example shown above demonstrates how simple and fast color adjustment is performed in said preferred embodiment.

Figure 2:
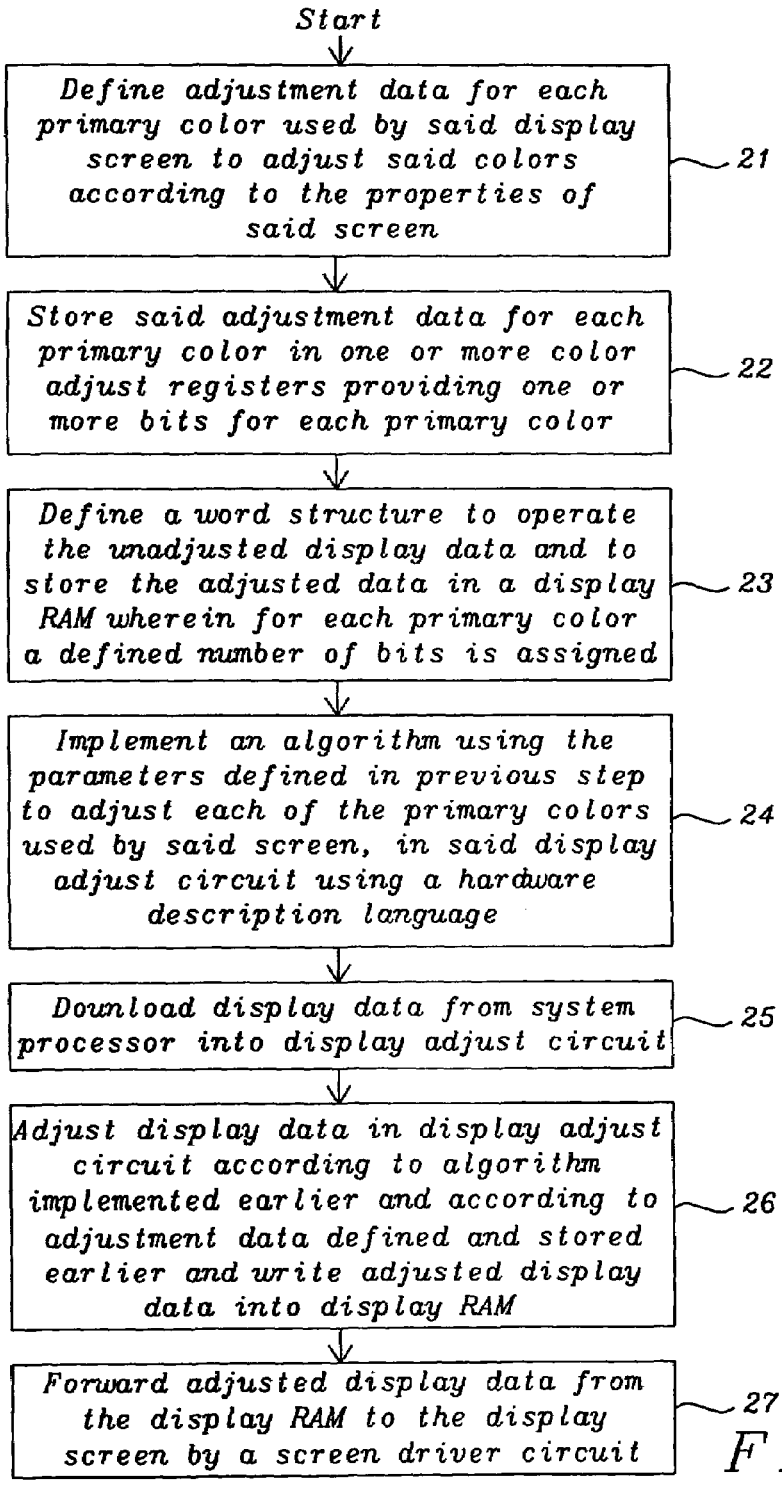
FIG. 2 shows a flowchart of the method invented.

FIG. 2 shows a related method to scale display data in a display driver circuit before it is written into a display RAM. The first step 21 of said method is to define adjustment data for each primary color used by said display screen to adjust said colors according to the properties of said screen. The following step 22 is to store said adjustment data for each primary color in one or more registers providing one or more bits for each primary color. Step 23 describes the definition of a word structure to operate the unadjusted display data and to store the adjusted data in a display RAM wherein for each primary color a defined number of bits is assigned. The next step 24 shows the implementation of an algorithm to adjust each of the primary colors, used by said screen, in said display adjust circuit using a hardware description language. Now in step 25 the display data are downloaded from the system processor into the display adjust circuit, followed by step 26 in which the display data, adjusted in the display adjust circuit according to the algorithm implemented earlier and according to the adjustment data defined and stored earlier, are written into the display RAM. In the last step 27 the adjusted display data are forwarded from the display RAM to the display screen by the screen driver circuit.

While the invention has been particularly shown and described with reference to the preferred embodiments thereof, it will be understood by those skilled in the art that various changes in form and details may be made without departing from the spirit and scope of the invention.

What is claimed is:

1. A system to adjust colors in any kind of electronic display comprising:

a color screen used as a display using primary colors of a color space;

a system processor sending downloading display data to a display driver circuit; and a display driver circuit comprising:

a processor interface logic providing the interface between said system processor and said display driver circuit;

a display adjust circuit adjusting the display data received from said system processor via said processor interface logic and writing a modified display data into a display RAM wherein said adjustment is performed for each color by linearly scaling by a programmable amount according equations by a simple operations of color adjust registers, wherein said amount corresponds to: adjustment=$color_{unadjusted}/2^n$, wherein n is a parameter set for each primary color;

said one or more color adjust registers;

the display RAM for storing the adjusted display data, and a screen driver controlling said screen and sending said adjusted display data to said screen.

2. The system of claim 1 wherein said color space is RGB.

3. The system of claim 1 wherein said color space is CMY.

4. The system of claim 1 wherein said screen is a LCD display.

5. The system of claim 4 wherein said LCD display is a CSTN display.

6. The system of claim 4 wherein said LCD display is a DSTN display.

7. The system of claim 1 wherein said screen is a TFT display.

8. The system of claim 1 wherein said screen is an OLED display.

9. The system of claim 1 wherein said display adjust circuit is using two color adjust registers to store the adjustment data defining the amount of adjustments.

10. The system of claim 9 wherein said color adjustment registers are storing the adjustment data for each of all primary colors of the color space selected.

11. The system of claim 10 wherein said color adjustment registers are comprising three bits to store the adjustment information for each of two primary colors and four bits for a third primary color.

12. The system of claim 11 wherein said color adjustment registers are comprising three bits to store the adjustment information for each of red color and blue color and four bits for green color.

13. The system of claim 1 wherein said display data are stored in said display RAM using a 16-bit word.

14. The system of claim 13 wherein said 16-bit word comprises five bits each for two primary colors and six bits for a third primary color.

15. The system of claim 14 wherein said 16-bit word comprises five bits for each red and blue 5 and 6 bits for green.

16. The system of claim 1 wherein the color display data is linearly scaled by programmable amount.

17. The system of claim 16 wherein the display data are adjusted for each color according equations which are implemented in said display adjust circuit using a hardware description language.

18. The system of claim 17 wherein the display data are adjusted for each color according equations which are implemented in said display adjust circuit using register transfer level (RTL) language.

19. The system of claim 16 wherein each primary color of the color display data is linearly scaled by programmable amount and wherein said programmable amount is defined in case of a required decrease of a primary color according to the equation $$color_{adjust}=color_{unadjust}-color_{unadjust}/2^n,$$

wherein $color_{adjust}$ is the value of the adjusted color, $color_{unadjust}$ is the value of unadjusted color, and n is a parameter set for each primary color according to the desired adjustment.

20. The system of claim 16 wherein each primary color of the color display data is linearly scaled by programmable amount and wherein said programmable amount is defined in case of a required increase of a primary color according to the equation $$color_{adjust}=color_{unadjust}+color_{unadjust}/2^n,$$

wherein $color_{adjust}$ is the value of the adjusted color, $color_{unadjust}$ is the value of unadjusted color, and n is a parameter set for each primary color according to the desired adjustment.

21. The system of claim 1 wherein said display driver circuit is implemented as an IC.

22. The system of claim 1 wherein said display driver circuit is implemented as an ASIC.

23. A method to adjust colors in any kind of electronic display comprising:

providing a display screen, a system processor, and a display driver circuit comprising a processor interface logic, a display adjust circuit, one or more color adjust registers, a display RAM and a screen driver circuit;

define adjustment data for each primary color used by said display screen to adjust said colors according to the properties of said screen;

store said adjustment data for each primary color in one or more registers providing one or more bits for each primary color;

define a word structure to operate the unadjusted display data and to store the adjusted display data in a display RAM wherein for each primary color a defined number of bits is assigned;

implement an algorithm to adjust each of the primary colors, used by said screen, in said display adjust circuit using a hardware description language;

download display data from system processor into display adjust circuit;

adjust display data in display adjust circuit according to algorithm implemented earlier, wherein said amount corresponds to: adjustment =$color_{unadusted}/2^n$, wherein n is a parameter set for each primary color and according adjustment data defined and stored earlier and write adjusted display data into display RAM; and forward adjusted display data from the display RAM to the display screen by the screen driver circuit.

24. The method of claim 23 wherein said primary colors belong to RGB color space.

25. The method of claim 23 wherein said primary colors belong to OMY color space.

26. The method of claim 23 wherein said word structure comprises a 16-bit word.

27. The method of claim 26 wherein said 16-bit word comprises five bits each for two primary colors and six bits for a third primary color.

28. The method of claim 27 wherein said 16-bit word comprises five bits for each red and blue 5 and 6 bits for green.

29. The method of claim 23 wherein said hardware description language is register transfer level (RTL) language.

30. The method of claim 23 wherein said algorithm to decrease a primary color value is $$color_{adjust}=color_{unadjust}-color_{unadjust}/2^n,$$

wherein $color_{adjust}$ is the value of the adjusted color, $color_{unadjust}$ is the value of unadjusted color, and n is a parameter set for each primary color according to the desired adjustment.

31. The method of claim 23 wherein said algorithm to increase a primary color value is $$color_{adjust}=color_{unadjust}[-]+color_{unadjust}/2^n,$$

wherein $color_{adjust}$ is the value of the adjusted color, $color_{unadjust}$ is the value of the unadjusted color, and n is a parameter set for each primary color according to the desired adjustment.

32. The method of claim 23 wherein said color adjustment registers are comprising three bits to store the adjustment data for each of two primary colors and four bits for a third primary color.

33. The method of claim 32 wherein said color adjustment registers are comprising three bits to store the adjustment data for each of blue and red and four bits for green.

34. The method of claim 33 wherein said adjustment data for the color red are the following bit combinations:

011=+25% (2-bit shift and add),
010=+12.5% (3-bit shift and add),
001=+6.3% (4-bit shift and add),
000=no change (default value),
101=−6.3% (4-bit shift and subtract),
110=−12.5% (3-bit shift and subtract),
111=−25% (2-bit shift and subtract).

35. The method of claim 33 wherein said adjustment parameters for the color blue are the following bit combinations:

011=+25% (2-bit shift and add),
010=+12.5% (3-bit shift and add),
001=+6.3% (4-bit shift and add),
000=no change (default value),
101=+6.3% (4-bit shift and subtract),
110=−12.5% (3-bit shift and subtract),
111=−25% (2-bit shift and subtract).

36. The method of claim 32 wherein said adjustment parameters for the color green are the following bit combinations:

0100=+25% (2-bit shift and add)
0011=+12.5% (3-bit shift and add)
0010=+6.3% (4-bit shift and add)
0001=+3.1% (5-bit shift and add)
0000=no change (default value)
1001=−3.1% (5-bit shift and subtract)
1010=−6.3% (4-bit shift and subtract)
1011=−12.5% (3-bit shift and subtract)
1100=−25% (2-bit shift and subtract).

* * * * *